US008678451B2

(12) United States Patent
Martin

(10) Patent No.: US 8,678,451 B2
(45) Date of Patent: Mar. 25, 2014

(54) GATE LATCH

(76) Inventor: Jim Martin, Murphy, TX (US)

( * ) Notice: Subject to any disclaimer, the term of this patent is extended or adjusted under 35 U.S.C. 154(b) by 0 days.

(21) Appl. No.: 13/531,045

(22) Filed: Jun. 22, 2012

(65) Prior Publication Data

US 2013/0270842 A1 Oct. 17, 2013

Related U.S. Application Data

(63) Continuation-in-part of application No. 13/444,699, filed on Apr. 11, 2012, now abandoned.

(51) Int. Cl.
*E05C 3/12* (2006.01)
*E05C 3/00* (2006.01)

(52) U.S. Cl.
USPC ..... 292/210; 292/121; 292/126; 292/219; 292/226; 292/DIG. 29

(58) Field of Classification Search
USPC ..... 292/1, 121, 122, 126, 128, 130, 131, 292/134, 136, 219, 220, 226, 228, 230, 231, 292/236, 238, DIG. 29, 210
See application file for complete search history.

(56) References Cited

U.S. PATENT DOCUMENTS 277,807 A * 5/1883 Stovall ..... 292/128
495,624 A * 4/1893 Coffield ..... 292/226
497,863 A * 5/1893 Christian ..... 292/24
635,363 A * 10/1899 Tripp ..... 292/299
673,183 A * 4/1901 Walsh ..... 292/128
790,637 A * 5/1905 Jones ..... 292/136
844,907 A * 2/1907 Aikin ..... 292/136
978,658 A * 12/1910 Schnell ..... 292/128
991,119 A * 5/1911 Warns ..... 292/31
1,193,531 A * 8/1916 Fogg ..... 292/134
1,204,228 A * 11/1916 Zanders ..... 292/128
1,260,444 A * 3/1918 Portesi ..... 292/226
1,314,268 A * 8/1919 Irwin ..... 292/236
1,314,978 A * 9/1919 Nelson ..... 292/128
1,588,289 A * 6/1926 Yenichek ..... 292/231
1,721,016 A * 7/1929 Gaskins ..... 292/226
1,762,883 A * 6/1930 Norman ..... 292/254
1,830,786 A * 11/1931 Ferris ..... 292/136
2,311,688 A * 2/1943 Olson ..... 292/126
2,410,347 A * 10/1946 Irwin ..... 292/126
2,592,871 A * 4/1952 Dole ..... 292/255
4,178,025 A * 12/1979 Robins ..... 292/117
4,451,072 A * 5/1984 Petty, Sr. ..... 292/128
4,690,440 A * 9/1987 Rogers ..... 292/54
4,871,203 A * 10/1989 Rogers ..... 292/238
4,887,854 A * 12/1989 Bulten ..... 292/238
5,782,507 A * 7/1998 Hardee ..... 292/267

FOREIGN PATENT DOCUMENTS

GB 2121096 A * 12/1983 ..... E05C 1/10

* cited by examiner

*Primary Examiner* — Carlos Lugo
(74) *Attorney, Agent, or Firm* — James R. Gourley; Carstens & Cahoon, LLP

(57) ABSTRACT

A gate latch for use with a gate may include a first handle to operate the gate latch from a first side of the gate and a second handle to operate the gate latch from a second side of the gate.

8 Claims, 5 Drawing Sheets

GATE LATCH

CROSS-REFERENCE TO RELATED APPLICATION

This application is a continuation-in-part of co-pending U.S. patent application Ser. No. 13/444,699 filed on Apr. 11, 2012, and entitled "A Gate Latch," the technical disclosure of which is hereby incorporated by reference in its entirety.

BACKGROUND OF THE INVENTION

1. Technical Field

The present invention relates to a door latch, and more particularly to a gate latch.

2. Background

Latches for swinging doors or gates are known. Such latches can use hook-shaped latch bolts which can pivot about an axis in order to hook behind a reception element on the opposite door post to lock the door. As actuating elements, door knobs or handles are provided which can rotate about an axis parallel to the rotation axis of the hook-shaped bolt. By rotating the door knob or handle, the hook-shaped bolt can be lifted by means of the bolt operating mechanism to unlock the door.

In this known lock a quite heavy hook-shaped latch bolt, or even a double latch bolt, must be provided. Indeed, when closing the swinging door or gate, the rebound of the door or gate against the opposite door post to which the bolt reception element is fixed may cause considerably large forces in the bolt. A drawback of such a hook-shaped latch bolt is that when mounting the lock against a profile of the door or the gate so that the bolt has to extend entirely through this profile, a quite large rectangular hole has to be made for the bolt in the profile. This is not only due to the dimensions of the latch bolt itself but also to the fact that the hook-shaped bolt must be enabled to move transversally to its longitudinal direction in the hole in the profile in order to be able to hook behind the bolt reception element to lock the door.

SUMMARY OF THE INVENTION

In one embodiment, a gate latch for a gate comprises a first handle for operating the gate latch from a first side of the gate and a second handle for operating the gate latch from a second side of the gate, wherein the first handle comprises a first pivot point between a first lever arm and a first latch bolt strike, and wherein the second handle comprises a second lever arm and a second latch bolt strike on one side of a second pivot point, wherein the second handle engages the first handle between the first pivot point and second pivot point.

In another embodiment, the gate latch comprises a cover over said first pivot point and said second pivot point. In another embodiment, the first handle and second handle are attached to a support plate at said first and second pivot points, wherein said support plate is attachable to said gate. In one embodiment, each latch bolt strike comprises a latch bolt receiving section and a latch bolt holding section.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

The gate latch of the present invention is intended for use on a hinged door that provides an opening to an otherwise fixed wall. In a preferred embodiment, the fixed wall is a fence and the hinged door is a gate. The terms "door" and "gate" are used herein interchangeably, and refer to any type of hinged door, gate or similar structure. In a most preferred embodiment, the gate latch of the present invention is affixed to a wall, and receives a latch bolt affixed to a door or gate. However, the gate latch would still work with the latch affixed to the gate and the bolt affixed to the wall.

Figure 1:
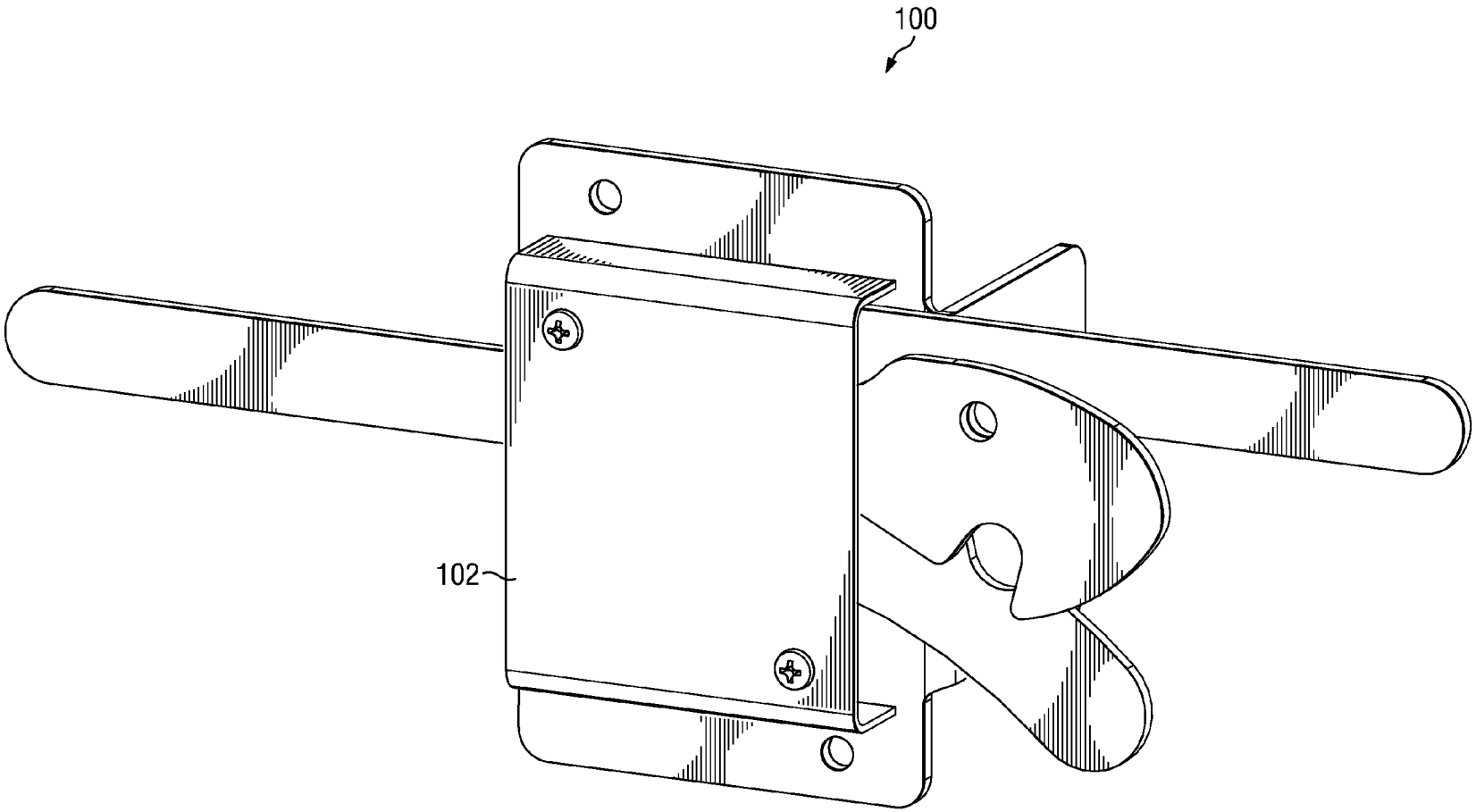
FIG. 1 illustrates a perspective view of one embodiment of the gate latch of the present invention with a cover.
Figure 4:
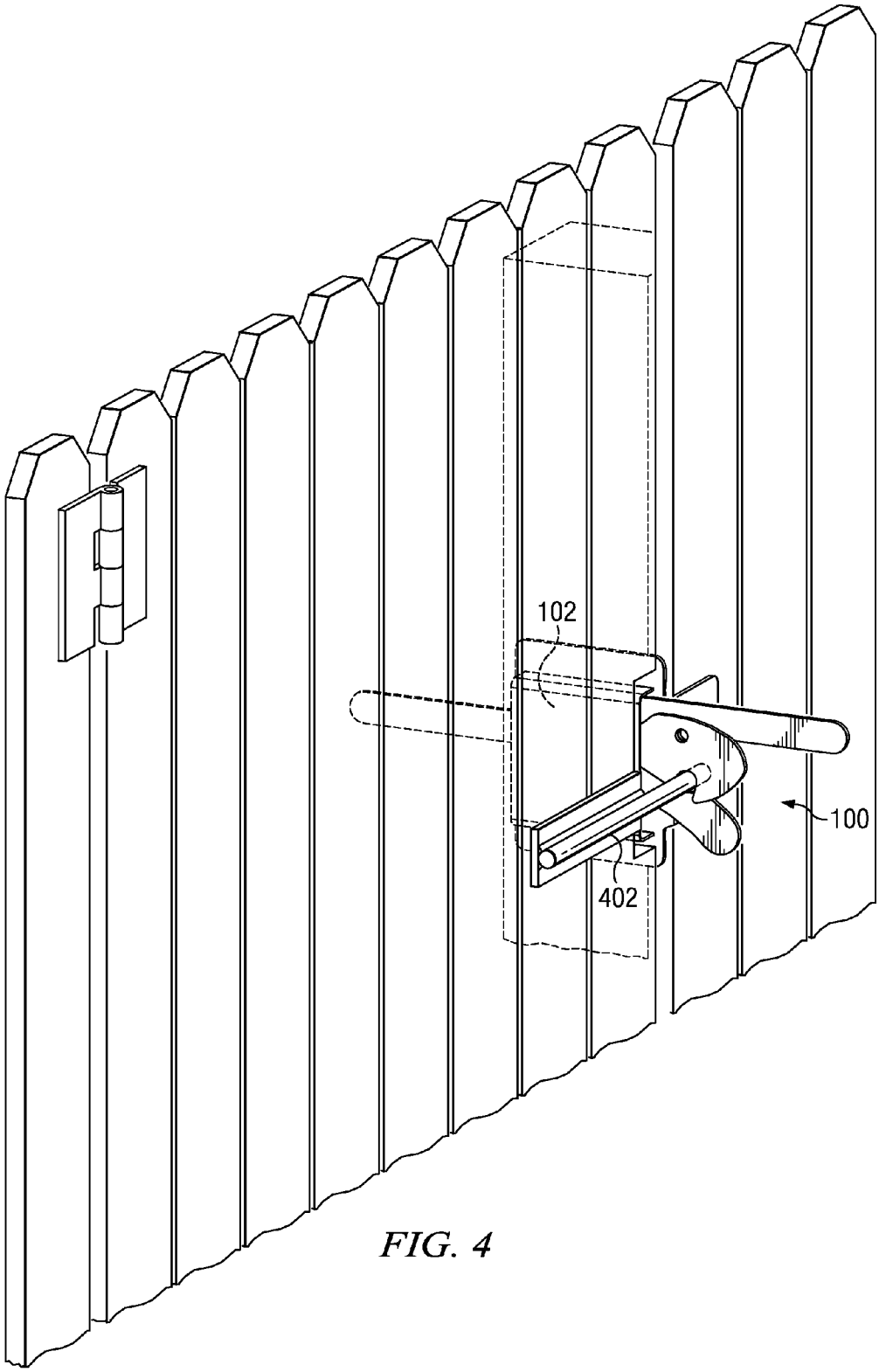
FIG. 4 illustrates a perspective view of one embodiment of the present invention in use with a gate.

FIG. 1 depicts a perspective view of one embodiment of the gate latch 100 of the present invention, with a cover 102 over some of the working parts of the latch. FIG. 4 depicts a perspective view of this embodiment of the gate latch 100 in use with a fence gate. In FIG. 4, the gate latch is affixed to a fence post and is configured to receive a complementary latch bolt 410 affixed to a swinging gate.

Figure 2A:
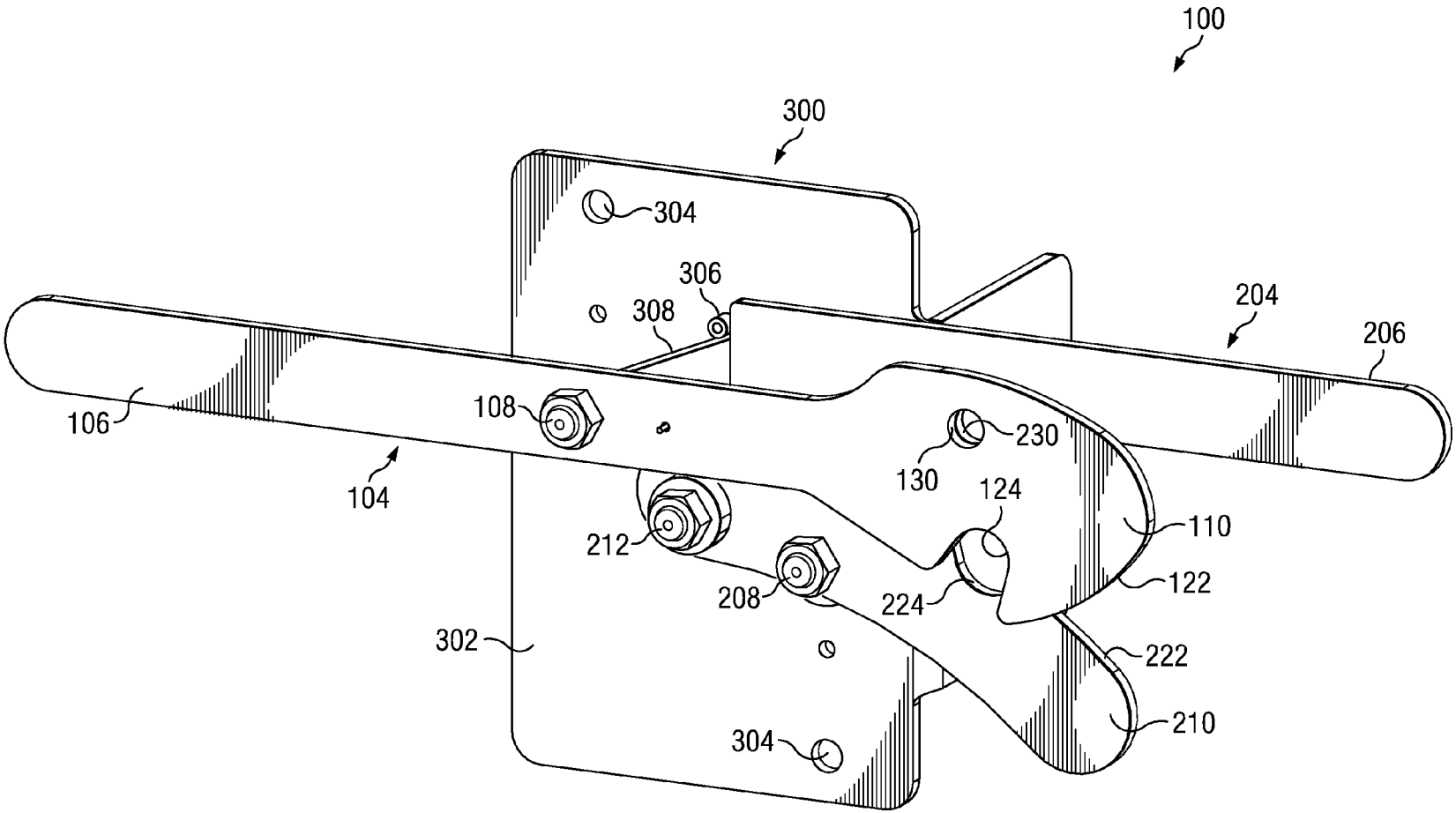
FIG. 2A illustrates a perspective view of one embodiment of the gate latch of the present invention without a cover and in the closed position.
Figure 2B:
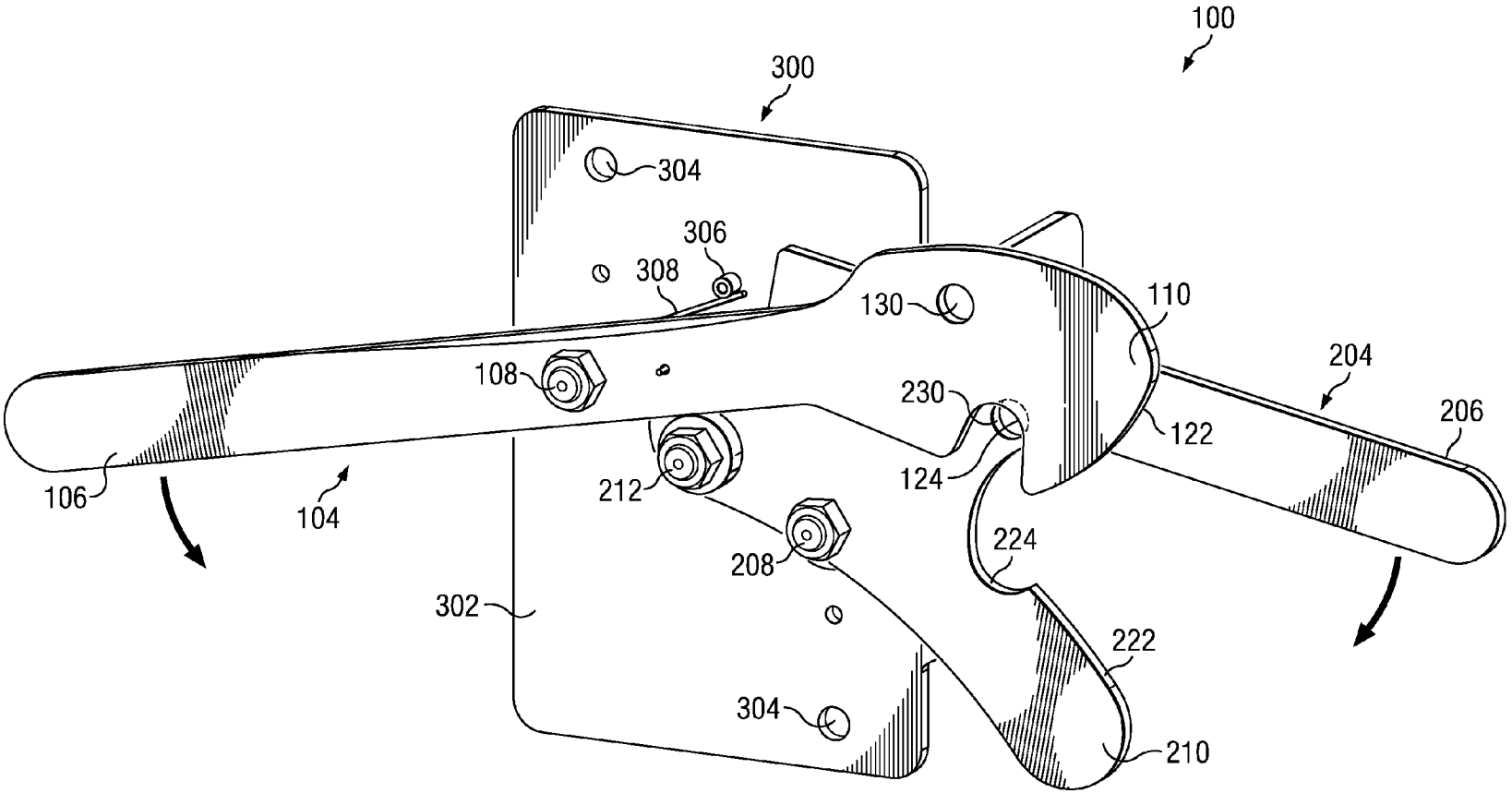
FIG. 2B illustrates a perspective view of one embodiment of the gate latch of the present invention without a cover and in the open position.

FIGS. 2A and 2B depict one embodiment of the present invention in the closed and open positions, respectively. The cover shown in FIGS. 1 and 4 has been omitted so that all working parts of the latch are visible. As depicted in the figures, the gate latch 100 comprises two handles 104 and 204, with each handle capable of operating the latch 100 from opposite sides of the fence or gate. The first handle 104 comprises a first pivot point 108 between a first lever arm 106 and a first latch bolt strike 110. The second handle 204 comprises a second lever arm 206 and a second latch bolt strike 210 on one side (i.e., the same side) of a second pivot point 208. The second handle 204 engages the first handle 104 at a location between the first pivot point 108 and the second pivot point 208. In the embodiment depicted in FIGS. 2A and 2B, the first handle 104 engages the bottom of the second handle 204 at the outer surface of a bearing 212 affixed to the first handle. The gate latch also comprises a spring element 308 that biases the latch towards a closed position.

When a user of the gate latch of the present invention presses down on the first lever arm 106 of the first handle 104, the first latch bolt strike 110 is lifted up. At the same time, gravity pulls the second lever arm 206 and second latch bolt strike 210 down, thereby releasing a gate latch bolt (depicted in FIG. 4, reference numeral 410) that has engaged the strikes. Likewise, when a user of the gate latch presses down on the second lever arm 206 of the second handle 204, the second latch bolt strike 210 also moves down. At the same time, the bearing 212 pushes up on the first handle 104, thereby moving the first latch bolt strike 110 up, releasing any gate latch bolt that has engaged the strikes. When either lever arm is released by the user, the spring element 308 biases the handles towards a closed position. In the embodiment depicted in FIGS. 2A and 2B, the spring element 308 biases the first handle 104 towards the closed position, which in turn biases the second handle 204 towards the closed position through application of force on the bearing 212. However, other biasing means can be used, including providing more weight on the end of the first handle 104 that defines the first latch bolt strike 110. Thus, one advantage of the present invention is that a gate can be opened from either side of a fence by pressing down on one of the handles.

Similarly, the gate latch of the present invention is also configured to receive and catch a gate latch bolt (depicted in FIG. 4, reference numeral 410) that impacts the strikes 110 and 210 while the gate latch is in a closed position. In this regard, each latch bolt strike comprises a bolt receiving section 122 and 222, and a bolt holding section 124 and 224. In the embodiment shown, the bolt receiving section is an inclined plane (which may be flat or curved) and the bolt holding section is a concave notch configured to be complementary in shape to the cross section of the latch bolt. When a door with a latch bolt affixed to it swings closed and the bolt impacts the strikes 110 and 210, the strikes move towards an open position allowing the bolt to seat itself in the bolt catching sections of the handles. The spring element closes the strikes once the bolt has moved into the catching sections. One aspect of the present invention that is an improvement over the prior art is that the latch will receive and catch a latch bolt attached to a gate that is misaligned with the latch. Typically, a latch bolt will be misaligned with the latch because the gate is sagging. However, regardless of which direction (up or down) the latch bolt is misaligned, the bolt receiving sections 122 and 222 will guide the latch bolt into the bolt holding sections 124 and 224.

In a preferred embodiment, the first handle 104 and second handle 204 each comprise complementary holes 130 and 230 which align when the gate latch is in the closed position. A user can pass a lock or bar (not shown) through the holes to render the handles and gate latch inoperable, as needed.

In the embodiment depicted in FIGS. 2A and 2B, a stop, for example in the form of a pin 306, is also included that serves two purposes. First, it provides support for one end of spring element 308. Second, it provides a stop for the second handle 204 so that the spring element 308 does not cause the strikes to close so far that they will not allow a latch bolt to engage the strikes.

All of the elements described above can be attached directly to the wall that receives the door or gate latch bolt. However, as depicted in FIGS. 1-4, these elements can be attached to a housing plate 300, which in turn is affixed to the wall or fence, as depicted in FIG. 4. The housing plate comprises a front face 302 with at least one hole 304, through which a user can insert screws, bolts, or similar attachment hardware in order to affix the housing to the wall or fence.

Figure 3:
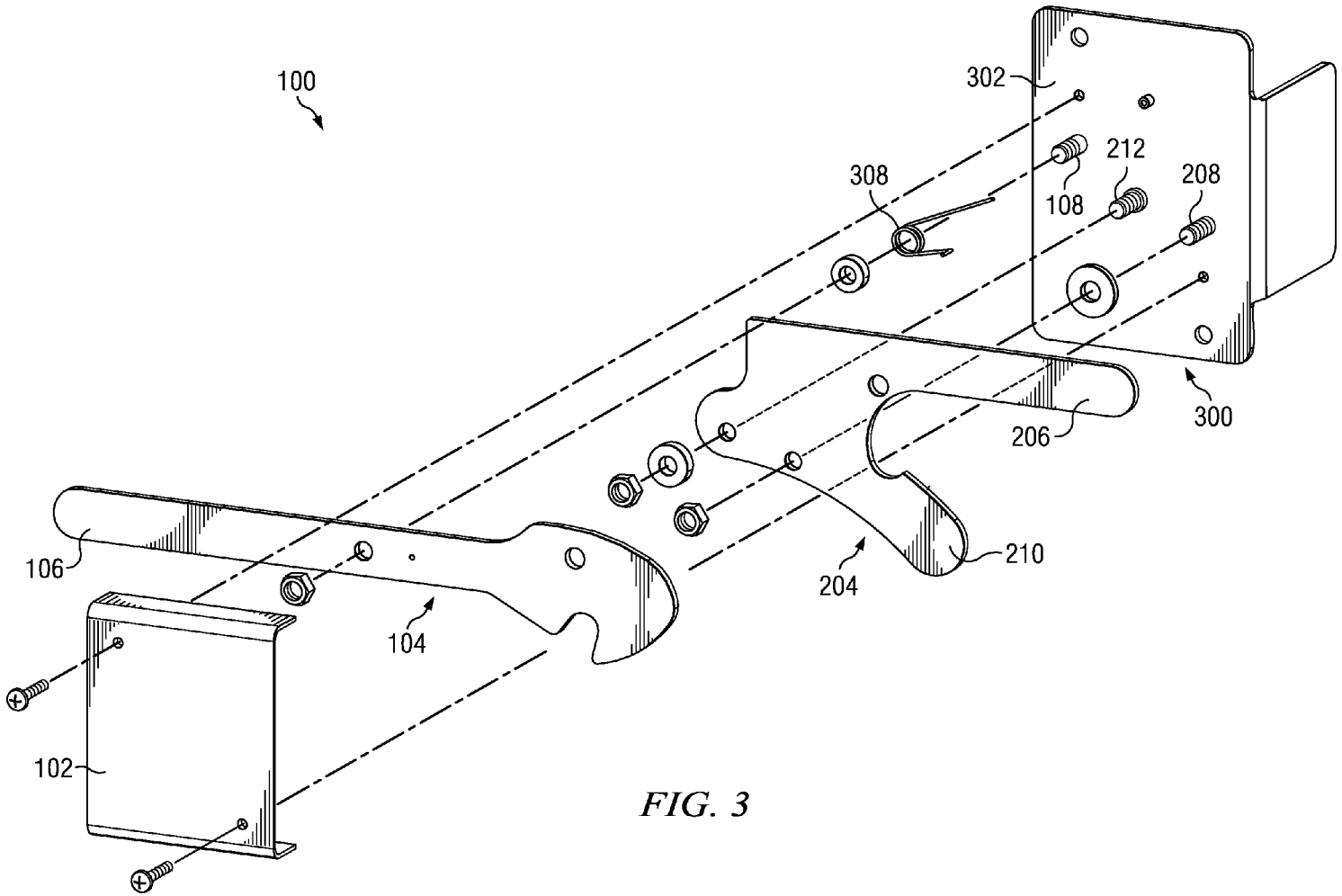
FIG. 3 illustrates an exploded view of one embodiment of the present invention.

FIG. 3 depicts an exploded view of the embodiment shown in FIG. 1. The cover is configured to cover over the first and second pivot points.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

What is claimed is:

1. A gate latch for use with a gate, said gate latch comprising:

a first handle for operating said gate latch from a first side of said gate and a second handle for operating said gate latch from a second side of said gate, wherein said first handle comprises a first pivot point between a first lever arm and a first latch bolt strike, said first latch bolt strike directly engaging a gate latch bolt, and wherein said second handle comprises a second lever arm and a second latch bolt strike on one side of a second pivot point, said second latch bolt strike directly engaging said gate latch bolt, wherein said second handle engages said first handle between said first pivot point and said second pivot point.

2. The gate latch of claim 1 wherein said first latch bolt strike and said second latch bolt strike are biased towards a closed position.

3. The gate latch of claim 1 wherein said first handle comprises a hole which aligns with a hold in said second handle when said gate latch is in a closed position.

4. The gate latch of claim 1 wherein said second handle engages said first handle at an outer surface of a bearing affixed to said second handle.

5. The gate latch of claim 2 wherein a spring element biases said first latch bolt strike and said second latch bolt strike towards said closed position.

6. The gate latch of claim 1 wherein each said latch bolt strike comprises a latch bolt receiving section and a latch bolt holding section.

7. The gate latch of claim 1 wherein said first handle is affixed to a mounting plate at said first pivot point, and wherein said second handle is affixed to said mounting plate at said second pivot point.

8. The gate latch of claim 1 further comprising a cover over said first pivot point and said second pivot point.

* * * * *